US006139392A

United States Patent [19]

Walker et al.

[11] Patent Number: 6,139,392

[45] Date of Patent: Oct. 31, 2000

[54] GLIDER TOY

[75] Inventors: Robert L. Walker, St. Charles; Charles M. Sostak, Lombard, both of Ill.

[73] Assignee: Robart Mfg. Inc., St. Charles, Ill.

[21] Appl. No.: 09/151,712

[22] Filed: Sep. 11, 1998

[51] Int. Cl.[7] ..... A63H 27/00

[52] U.S. Cl. ..... 446/61; 446/34

[58] Field of Search ..... 446/34, 61, 62, 446/67, 68

[56] References Cited

U.S. PATENT DOCUMENTS

| | | | |
|---|---|---|---|
| 3,222,718 | 12/1965 | Brandstetter | 446/62 |
| 3,232,002 | 2/1966 | Harrison | 446/34 |
| 3,246,425 | 4/1966 | Miller | 446/62 |
| 3,533,186 | 10/1970 | Sullivan | 446/61 |
| 4,863,412 | 9/1989 | Mihalinec | 446/62 X |
| 5,090,636 | 2/1992 | Sadowski | 446/61 X |
| 5,178,655 | 1/1993 | Lane | 446/61 X |
| 5,846,112 | 12/1998 | Baker | 446/68 |

*Primary Examiner*—Sam Rimell
*Attorney, Agent, or Firm*—Hill & Simpson

[57] ABSTRACT

A glider includes an aircraft body with a bottom surface and a longitudinal center of gravity. On the bottom surface are a number of depressions. The depressions are adapted to receive the fingers of the user. A first depression is positioned along a center line of the aircraft body. At least two other depressions are positioned between the first depression and a front end of the aircraft body. A weight receptacle is located near the front of the aircraft body and provides for increasing or decreasing the amount of weight needed in the aircraft depending on the desired flight pattern.

12 Claims, 1 Drawing Sheet

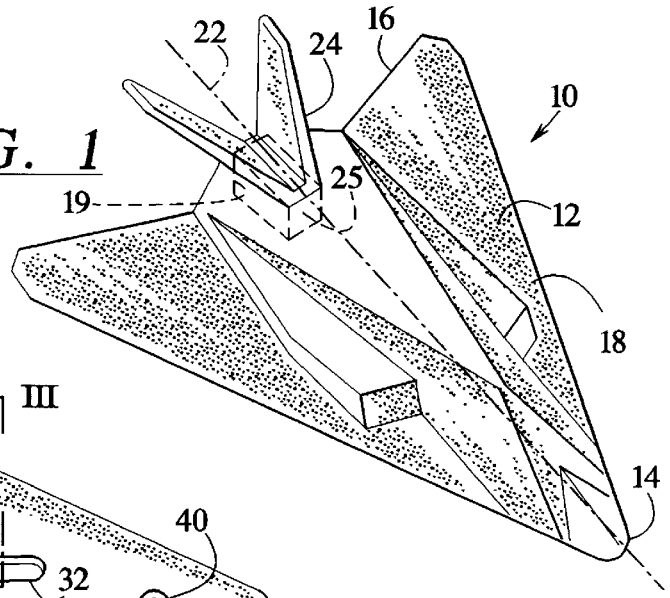
FIG. 1
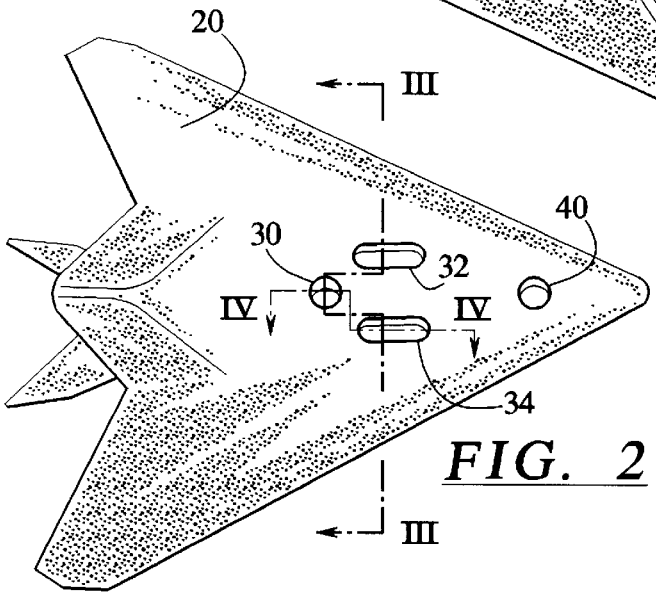
FIG. 2
FIG. 3
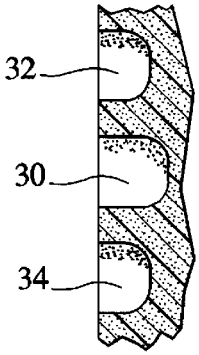
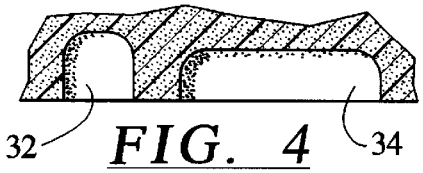
FIG. 4
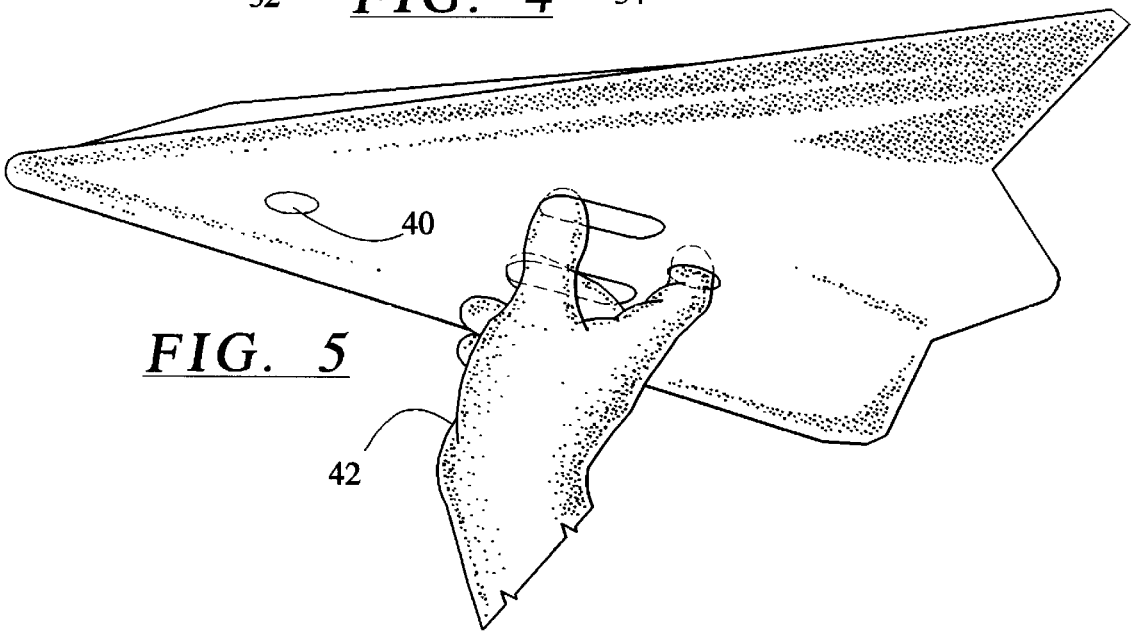
FIG. 5

GLIDER TOY

BACKGROUND OF THE INVENTION

The present invention generally relates to aerial toys and in particular to a glider toy.

Aerial toys of various shapes and sizes are popular among children and adults alike. One example of an aerial toy is disclosed in Miller, U.S. Pat. No. 3,246,425 entitled "Aerial Glider Toy." The disclosed aerial toy includes a molded unitary structure with a specialized delta wing to provide stability in flight.

Another example of an aerial toy, is disclosed in Sadowski, U.S. Pat. No. 5,090,636 entitled "AIRCRAFT." This aerial toy includes an upward step in the underside of the body in the center of the aircraft. The upper step defines a rearwardly facing riser surface. The step and riser surface are located at the front-to-rear center of gravity of the aircraft. The body portion of the aircraft that is positioned forwardly of the step counterbalances the weight from the wings near the back of the aircraft. The aircraft also has a grip area that is designed as a projecting portion on the underside of the aircraft.

Often times it is difficult for the user to obtain a sturdy grip on the aerial toy. In applications, such as those disclosed above, the grip area projects from the underside of the aerial toy. Such grip areas are cumbersome and affect the aerodynamics of the toy. Also, such grip areas do not allow for much force by the user when the user attempts to push the aerial toy into the air.

It is desirable to improve the stability of the aerial glider. Further, it is also desirable to provide a sturdy grip area. In addition, it is desirable to provide an aerial glider toy that accommodates the user's fingers in order to provide an improved grasp of the glider and an effective launch of the glider.

SUMMARY OF THE INVENTION

The present invention provides an aerial glider toy incorporating a finger grip area.

To this end, in an embodiment of the present invention, a glider toy includes an aircraft body with a bottom surface and a longitudinal center of gravity. The bottom surface further includes a number of depressions that are adapted to receive the fingers of the user. The depressions are positioned slightly forward of the longitudinal center of gravity.

In an embodiment, the glider toy has at least one depression that is adapted to receive the index finger and is positioned along a center line of the aircraft body.

In an embodiment, the glider toy has a pair of elongated depressions that are positioned parallel to each other and symmetrically about the center line of the aircraft body.

In an embodiment, the glider toy includes a weight receptacle positioned near the front end of the aircraft body and along the center line of the aircraft body.

An advantage of the present invention is an aerial glider toy with a configured finger grip area.

Another advantage of the present invention is an aerial glider toy that allows the user to have a solid grasp of the glider.

Another advantage of the present invention is an aerial glider toy that has effective launching capability and provides a final launch boost.

Another advantage of the present invention is an aerial glider toy with improved aerodynamic elements which will increase the distance of flight.

These and other advantages and/or features of the present invention are described below in the following detailed description of the presently preferred embodiments with reference to the accompanying drawings.

DETAILED DESCRIPTION OF THE DRAWINGS

FIG. 1 is a perspective top view of an aerial glider toy embodying principles of the invention.

FIG. 2 is a bottom view of the aerial glider toy of FIG. 1 incorporating the inventive figure grip area.

FIG. 3 is a cross-sectional front view of the aerial glider toy of FIG. 2.

FIG. 4 is a cross-sectional side view of the aerial glider toy of FIG. 2.

FIG. 5 is a perspective bottom view of the aerial glider toy of FIG. 1 during its application.

DETAILED DESCRIPTION OF THE PREFERRED EMBODIMENTS

FIG. 1 shows an aerial glider toy 10. In a preferred embodiment, the aerial glider toy 10 includes a substantially triangular body portion 12 that has a front end 14 and a back end 16. As illustrated in FIG. 1, the triangular body portion is in the shape of an F-117 aircraft. Of course, alternative aircraft designs may be substituted for the triangular body portion 12 described herein.

The glider toy may be made from any combination of materials suitable for providing an object whose weight allows for flight yet whose strength provides requisite rigidity for maintaining flight, be it the wing shape maintenance or otherwise. In a preferred embodiment, the glider toy is made entirely from expanded polystyrene foam. However, other materials which can be expanded, molded or shaped and come to mind are: other polymeric foams, urethane foams, balsa wood, thermofoam plastic or thermo set plastic, to name a few. No claim is made herein that these various materials are equivalent to one another except that it is envisioned that glider toys might be made out of such different materials.

The body portion 12 also has a top surface 18 and a bottom surface 20. The top surface 18 has a rectangular depression 19 near the back end 16. The rectangular depression 19 is symmetrically positioned along a center line 22 of the triangular body portion 12. A substantially V-shaped tail 24 includes a rectangular projecting portion at the bottom of the "V" 25. The rectangular projecting portion 25 is adapted to be mounted into the rectangular depression 19 on the top surface 18. To this end, the substantially V-shaped tail 24 can be removed from the triangular body portion 12. This removable feature allows for the replacement of alternative tails having various structures depending on the desired flight of the glider toy. The removable feature of the V-shaped tail 24 is also advantageous when transporting and/or packaging the glider 10 because it makes the toy more compact. When the glider toy is transported and/or packaged the tail 24 can be removed and placed on the nose of the glider 10 by inverting the tail 24.

FIGS. 2 through 5 show the aerial glider toy incorporating principles of the invention. FIG. 2 illustrates the bottom surface 20 of the aerial glider toy 10 incorporating the inventive finger grip area. Specifically, a cavity 30 and a pair of elongated depressions 32, 34 are positioned on the underside of the glider toy 10.

In a preferred embodiment, the cavity 30 is generally circular in shape. The cavity 30 and the pair of elongated depressions 32, 34 are positioned slightly forward of the longitudinal (horizontal) center of gravity of the glider toy 10. The pair of elongated depressions 32, 34 are spaced equal distance on either side of the center line and are adapted to receive a thumb and middle finger (or middle and third finger) of a user. The pair of elongated depressions 32, 34 are oval in shape (FIG. 4, discussed below illustrates the benefits of this shape). Alternative embodiments may incorporate shapes other than the oval shape (e.g. rectangular or square) to accommodate the thumb and middle finger (or middle and third finger) of the user.

The circular cavity 30 is positioned behind the pair of elongated depressions 32, 34 and generally along the center line 22 of the glider toy body 10. The generally circular cavity 30 is adapted to receive an index finger of the user. To this end, the circular cavity 30 extends further into the body portion 12 in comparison to the pair of elongated depressions. The deeper circular cavity 30 accommodates both the index finger and the hand positioning of the user.

A weight receptacle 40 is optimally positioned near the front end 14 (e.g. the underside of the nose). The weight receptacle 40 is adapted to receive a weight (not shown). The glider toy weight can be adjusted by increasing or decreasing the amount of weight within the weight receptacle 40. Different amounts of weight are desirable depending upon the distance the user seeks to fly the glider. Generally, the weight is of a suitable plug material so that the user can adjust the weight. Such materials may be malleable or rigid. In a preferred embodiment, the shape of the weight receptacle 40 is slightly larger in diameter then the size of a quarter. To this end, the user can simply adjust the weight by placing a malleable material, such as a non-toxic clay plug in the weight receptacle 40. For additional weight, the user can adjust the weight by using a rigid material such as coins (e.g. quarters) or washers. In the presently preferred embodiment, the user positions one, two or more coins or washers in the receptacle 40 depending on the desired weight. Of course, the shape of the receptacle 40 can vary but still achieve the desired capability of changing the amount of weight. Modifications to the shape and size of the weight receptacle 40 is also necessary because the density of the product may not be the same between different types of aircraft bodies.

FIG. 3 shows a cross-sectional view of the cavity 30 and elongated depressions 32, 34 from a front view of the glider toy 10 taken along the line marked "III" in FIG. 2. In FIG. 3, the circular cavity 30 is the center depression. Again, the circular cavity 30 extends further into the body 12 of the glider toy 10 in comparison to each of the elongated depressions 32, 34.

In FIG. 4, the shape of one of the pair of elongated depressions 34 is illustrated. FIG. 4 is a cross-sectional view taken from a side view of the glider toy 10 along the line marked "IV" in FIG. 2. The circular cavity 30 is located on the left in FIG. 4. One of the pair of elongated depressions 34 is located to the right. The inventive configuration of the cavity 30 and the elongated depressions 32, 34 allows for a sturdy grasp of the glider. The configuration also promotes the aerodynamic capability of the glider. Additionally, the positioning of the index finger in the circular cavity 30 provides for a final launch boost of the glider toy.

In the preferred embodiment described above, the cavity 30 and elongated depressions 32, 34 are formed as blind openings in the undersurface 20 of the glider 10. However, alternative embodiments may include variations of the shape of the cavity 30 and the depressions 32, 34. For example, if the body portion 12 of the glider is a curved fuselage area the thumb and middle finger depressions (e.g. the pair of elongated depressions) could be formed as indentations along the curved sides of the fuselage.

FIG. 5 shows the glider toy 10 in its application with the user. In FIG. 5, the glider toy 10 is positioned on the user's hand 42 via the thumb, index finger, and middle finger. In this application, as the user pushes the glider 10 forward into the air the index finger can provide a final boost to assist in an effective launch of the glider toy. Such a design allows for the glider toy to achieve greater distances than previously accomplished.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A toy glider, comprising:

an aircraft body having a front end, a bottom surface and a longitudinal center of gravity, the bottom surface further comprising a plurality of depressions adapted to receive the fingers of a user, the plurality of depressions positioned slightly forward of the longitudinal center of gravity towards the front end.

2. The toy glider in claim 1, wherein the plurality of depressions includes at least one depression along a center line of the aircraft body, the at least one depression being adapted to receive the index finger.

3. The toy glider in claim 1, wherein the plurality of depressions includes a pair of elongated depressions positioned parallel to each other and symmetrical about a center line of the aircraft body.

4. The toy glider in claim 1, further comprising a weight receptacle positioned near a front end of the aircraft body and along a center line of the aircraft body.

5. The toy glider of claim 1, wherein the aircraft body further includes a center line extending between the front end and a back end of the aircraft body and the plurality of depressions further includes one depression along the center line of the aircraft body and a pair of depressions positioned in parallel to each other on opposite sides of the center line.

6. The toy glider in claim 1, wherein the aircraft body is a polymeric foam.

7. The toy glider in claim 1, wherein the aircraft body is a shaped balsa wood.

8. A toy glider, comprising:

an aircraft body having a lower surface, a front end, a back end and a longitudinal center of gravity, the aircraft body further comprising a plurality of depressions being positioned on the lower surface;

a first receptacle on the lower surface along a center line of the aircraft body, wherein the center line extends between the front end and back end, the first receptacle being adapted to receive an index finger of a user; and a second and third receptacle positioned on the lower surface slightly forward of the first receptacle and symmetrical about the center line.

9. The toy glider in claim 8, wherein the first, second and third receptacles are positioned slightly forward of the longitudinal center of gravity.

10. The toy glider in claim 8, wherein the second and third receptacles are elongated and the second receptacle is adapted to receive a thumb of the user, and the third receptacle is adapted to receive a finger of the user.

11. The toy glider in claim 8, further comprising:

a fourth receptacle positioned near the front end of the aircraft body, the fourth receptacle being adapted to receive a weight.

12. A toy glider, comprising:

an aircraft body having a bottom surface and a longitudinal center of gravity, the bottom surface further comprising a plurality of depressions adapted to receive the fingers of a user, the plurality of depressions positioned slightly forward of the longitudinal center of gravity, wherein the plurality of depressions includes at least one depression along a center line of the aircraft body, the at least one depression being adapted to receive the index finger, and a pair of elongated depressions positioned parallel to each other and symmetrically about the center line of the aircraft body; and a weight receptacle positioned near a front end of the aircraft body and along a center line of the aircraft body.

* * * * *